US005657877A

United States Patent [19]

Yoshida et al.

[11] Patent Number: 5,657,877

[45] Date of Patent: Aug. 19, 1997

[54] ROTARY CLASSIFIER FOR A ROLLER MILL

[75] Inventors: Hirohisa Yoshida; Tsugio Yamamoto; Yutaka Iida; Shuichi Sakota, all of Nagasaki, Japan

[73] Assignee: Mitsubishi Jukogyo Kabushiki Kaisha, Tokyo, Japan

[21] Appl. No.: 533,105

[22] Filed: Sep. 25, 1995

[30] Foreign Application Priority Data

Apr. 4, 1995 [JP] Japan ..... 7-078913

[51] Int. Cl.[6] ..... B07B 1/22

[52] U.S. Cl. ..... 209/303; 209/393

[58] Field of Search ..... 209/393, 394, 209/395, 303, 270

[56] References Cited

U.S. PATENT DOCUMENTS

| | | | |
|---|---|---|---|
| 3,670,886 | 6/1972 | Hosokawa et al. . | |
| 3,831,752 | 8/1974 | Holloway | 209/394 |
| 3,901,801 | 8/1975 | Bixby | 209/395 |
| 4,257,880 | 3/1981 | Jones . | |
| 4,487,695 | 12/1984 | Connolly | 209/303 X |
| 5,255,790 | 10/1993 | Einoder et al. | 209/395 X |
| 5,472,095 | 12/1995 | Malm | 209/303 |

FOREIGN PATENT DOCUMENTS

| | | |
|---|---|---|
| 1064346 | 4/1967 | European Pat. Off. . |
| 0 283 682 | 4/1989 | European Pat. Off. . |
| 2 460 725 | 1/1980 | France . |
| 63-236547 | 10/1988 | Japan . |
| 63-236548 | 10/1988 | Japan . |
| 2-68149 | 3/1990 | Japan . |
| 5-8075 | 2/1993 | Japan . |

*Primary Examiner*—D. Glenn Dayoan

[57] ABSTRACT

The present invention provides a rotary classifier for a roller mill, in which a rotating vane is formed so that the vane width at the upper part of the rotating vane is larger than that at the lower part.

12 Claims, 6 Drawing Sheets

ROTARY CLASSIFIER FOR A ROLLER MILL

FIELD OF THE INVENTION AND RELATED ART STATEMENT

The present invention relates to a rotary classifier for a roller mill used for a pulverized coal firing boiler or the like.

FIG. 2 shows an ordinary roller mill. In this roller mill, pulverized coal is carried up by an air current, and classified into coarse and fine particles by a rotary classifier 2. The fine particles are taken out of the mill as product coal together with the air current. The coarse particles are returned to a table 5 and ground again. In FIG. 2, reference numeral 1 denotes a coal feeding tube, 3 denotes a rotating vane, 4 denotes hydraulic load equipment, 6 denotes hot gas, 7 denotes a classifier driving unit, and 8 denotes a product coal outlet.

On the rotary classifier 2, rotating vanes 3 for providing a classifying force are arranged around the circumference as shown in FIG. 3. The width W of the rotating vane 3 is constant vertically as shown in FIG. 4.

The primary aim of the rotary classifier 2 is to provide a sharp classifying characteristic, that is, to minimize the inclusion of coarse particles in the fine particles, which are the product. This is because if many coarse particles are included when the pulverized coal is burnt in a boiler, the combustion efficiency decreases.

On the cone-shaped classifier shown in FIG. 3, the conventional rotating vane 3 has a disadvantage that because the width W is constant vertically, the ratio of area that the width W of the rotating vane 3 occupies in the circumferential direction is high at the lower part and low at the upper part. Therefore, the pulverized coal particles carried by the air current have a high collision probability $\eta$ when passing through the lower part of the rotating vane 3, and a low collision probability $\eta$ when passing through the upper part of the rotating vane 3.

Regarding the flow of particles around the classifier, as shown in FIG. 5, the coarse particles S tend to pass through the upper part of the rotating vane 3 because of their high straight advancing property due to high inertia force, while the fine particles M tend to pass through the lower part of the rotating vane 3. Reference character L denotes the air current.

As described above, the conventional rotating vane 3 has a disadvantage that the collision probability $\eta$ is low at the upper part of the rotating vane, which many coarse particles pass through. This greatly hinders the improvement in coarse particle classifying property.

OBJECT AND SUMMARY OF THE INVENTION

The present invention was made to solve the above problem. Accordingly, an object of the present invention is to provide a rotary classifier for a roller mill, which offers an excellent classifying property.

To achieve the above object, according to the present invention, a rotating vane is formed so that the vane width at the upper part of the rotating vane is larger than that at the lower part, which prevents the decrease in the collision probability $\eta$ of the particles carried by air current at the upper part, so that the coarse particle classifying efficiency can be improved.

The operation and principle of this rotary classifier has been described in detail in the prior applications of the inventor et al. (Japanese Patent Application No. S62-67907 and No. S62-67908); therefore, they are omitted in this specification. The important thing is the operation of a classification zone on the rotating vane (C). The flow of particles in the rotating vane is shown in FIG. 8. In this figure, the coarse particles, which has a high straight advancing property, tend to enter the zone (C), as shown in FIG. 7. As described above, the coarse particles mostly pass through the upper part of the rotating vane and concentrate in the zone (C) in the rotating vane. Therefore, it may safely be said that the operation of the zone (C) at the upper part of the vane governs the coarse particle classifying efficiency.

A lower collision probability $\eta$ at the upper part of the vane, described above, means that the ratio of the zone (C) in FIG. 7 decreases at the upper part of the conventional classifying vane having a constant width. The rotating vane having a large width at the upper part, in accordance with the present invention, prevents the decrease in the ratio of the zone (C) at the upper part of the rotating vane, providing an operation for remarkably improving the collision probability $\eta$ of the coarse particles colliding with the rotating vane.

As described above, in the present invention, the rotating vane is so configured that the vane width is larger at the upper part than at the lower part, so that the ratio of area that the width of rotating vane occupies in the circumferential direction increases at the upper part, which increases the collision probability of the particles, carried by the air current, colliding with the vane at the upper part, by which the effect of providing a sharp classifying characteristic can be achieved. Therefore, according to the present invention, the classifying characteristic of the rotating vane can be improved.

DETAILED DESCRIPTION OF PREFERRED EMBODIMENTS

Figure 1A:
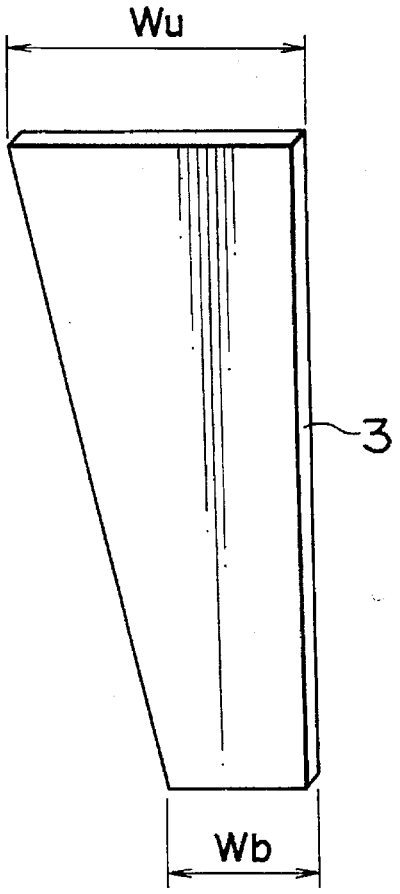
FIGS. 1*a* and 1*b* are perspective views of a rotating vane in accordance with one embodiment of the present invention.
Figure 1B:
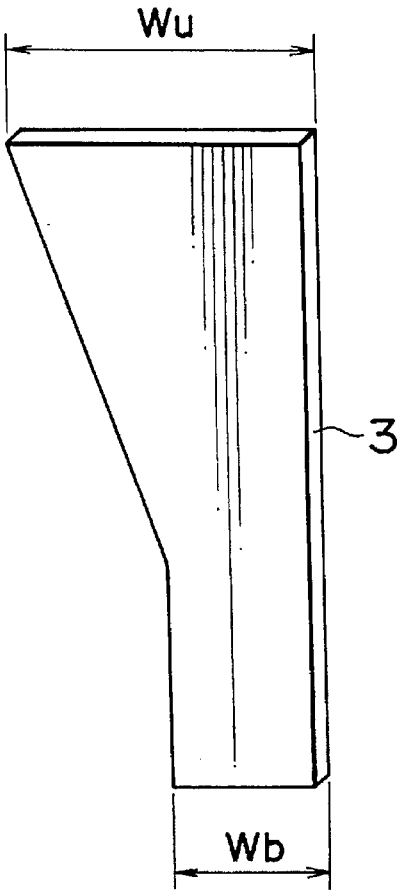
Figure 2:
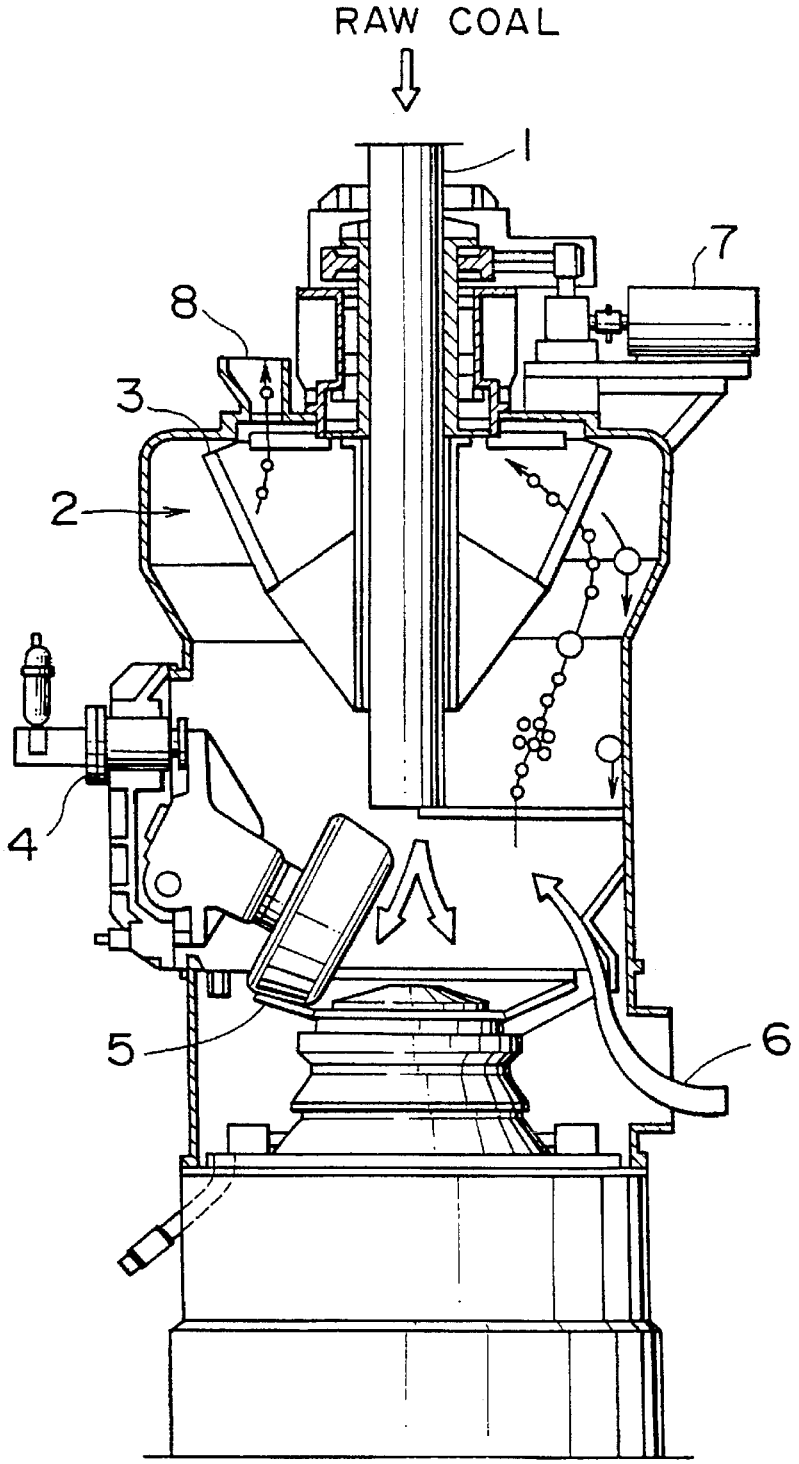
FIG. 2 (PRIOR ART)
FIG. 2 is a sectional view of a roller mill having a rotary classifier.
Figure 3:
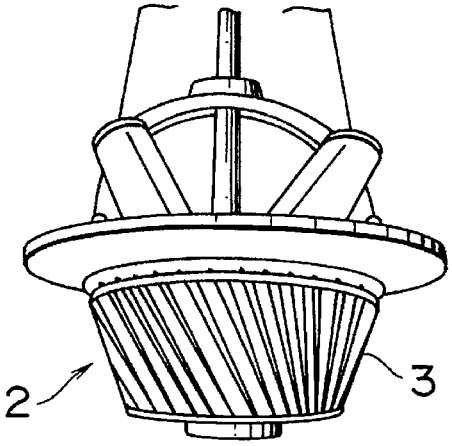
FIG. 3 is a perspective view of a rotary classifier.
Figure 4:
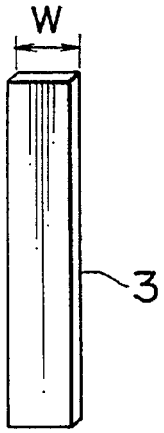
FIG. 4 (PRIOR ART)
FIG. 4 is a perspective view of a conventional rotating vane.
Figure 5:
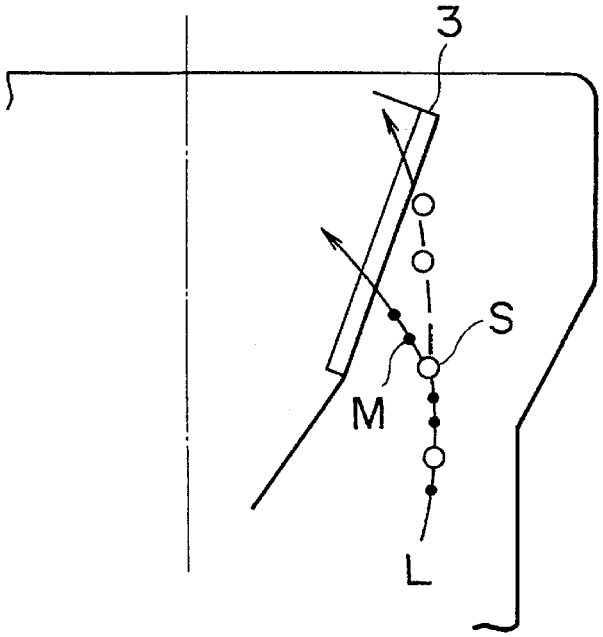
FIG. 5 is a schematic view showing the flow of particles around the rotary classifier.
Figure 6:
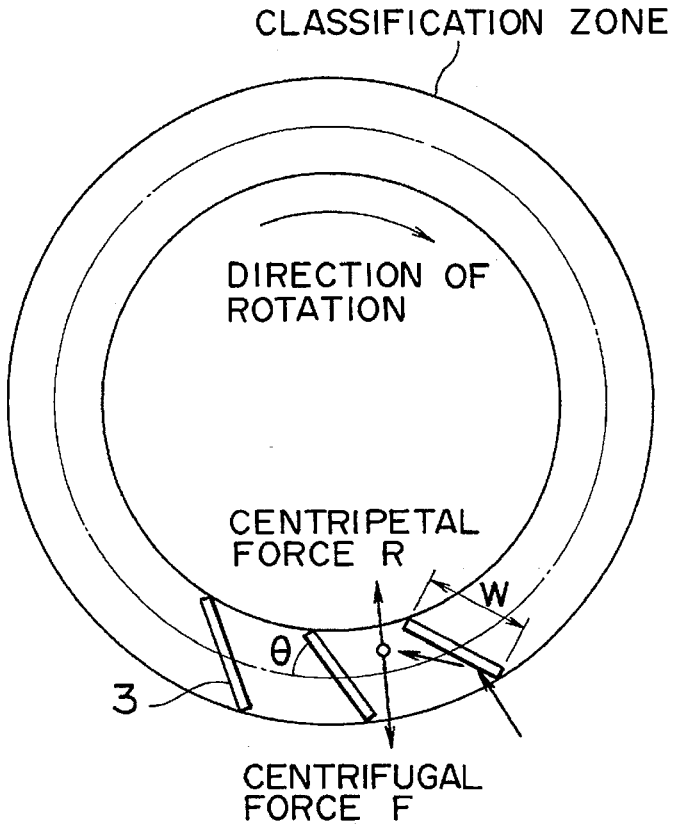
FIG. 6 is a view showing the classification principle of the rotary classifier.

FIGS. 1(*a*) and 1(*b*) show embodiments of the present invention.

Figure 7:
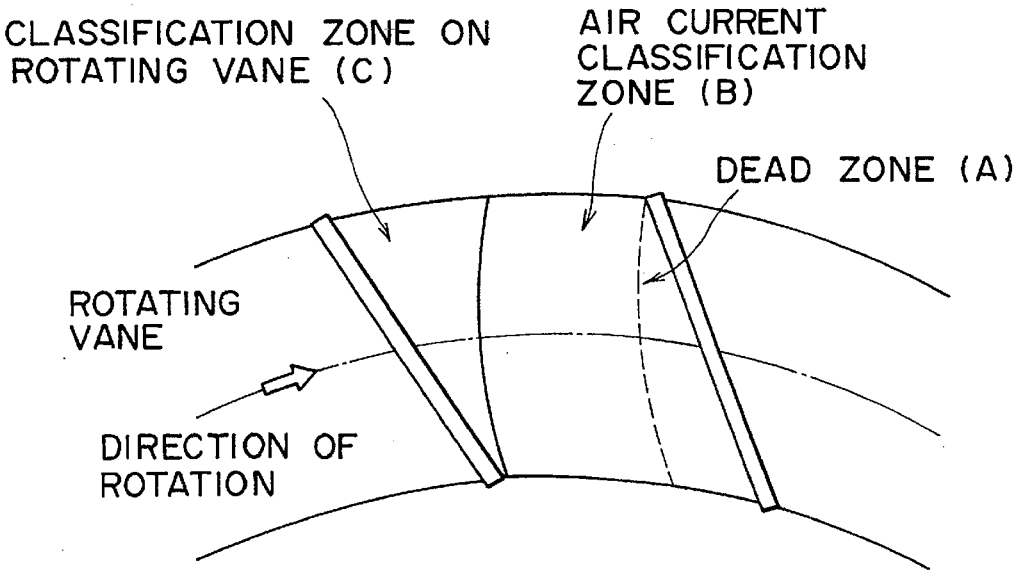
FIG. 7 is a view showing classification zones of the rotary classifier.
Figure 8:
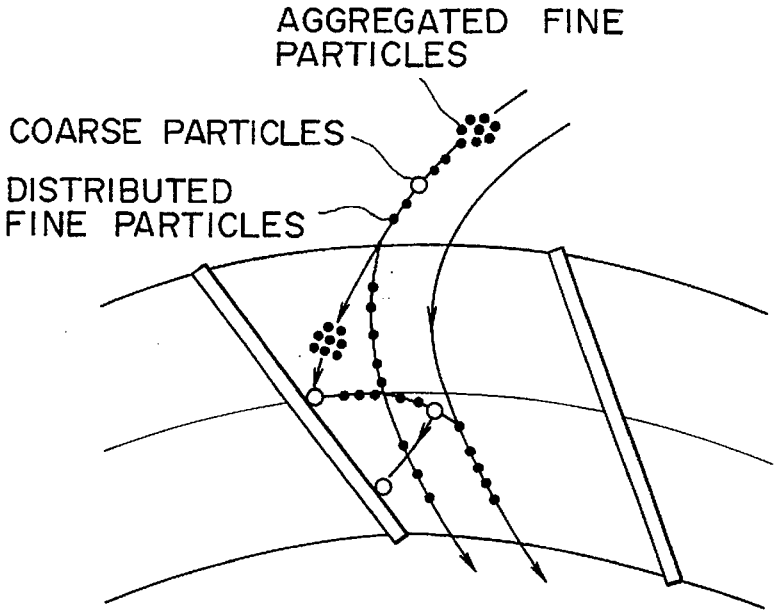
FIG. 8 is a schematic view showing the flow of particles in the classifying vane.

As shown in FIG. 7, taking the dead zone as A, the air current classification zone as B, and the classification zone on a rotating vane as C, the aforementioned collision probability $\eta$ is defined as $\eta$=zone (C)/{zone (A+B+C)}. FIG. 1(*a*) shows a rotating vane in which $\eta$ is almost constant, while FIG. 1(*b*) shows a rotating vane in which $\eta$ at the upper part where the coarse particles concentrate is nearly the same as that at the lower part.

In FIGS. 1(*a*) and 1(*b*), it is preferable that the relationship between the width Wu at the upper part and the width Wb at the lower part of the rotating vane 3 be Wu=1.5 to 3 Wb. If the width Wu at the upper part of the rotating vane 3 is not larger than 1.5 times the width Wb, the amount of coarse particles increases undesirably. If the width Wu at the upper part of the rotating vane 3 is not smaller than 3 times the width Wb, the pressure loss of particles increases undesirably.

Figure 9:
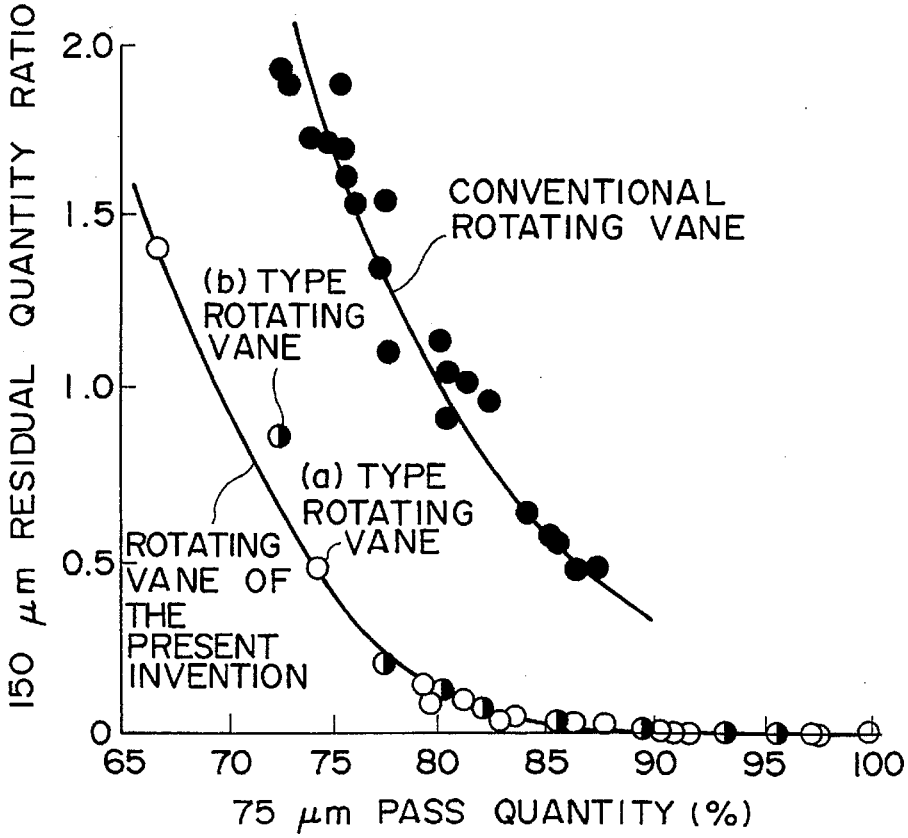
FIG. 9 is a view showing the effect of the present invention.

FIG. 9 shows a result of a comparison test in which a comparison was made between the rotating vane having a larger width at the upper part, in accordance with the present invention, and the conventional rotating vane having a constant width. From this figure, it is found that even when the degree of fineness of the product coal (expressed by 75 μm pass quantity on the abscissa) is equal, the rotating vane of the present invention can significantly decrease the amount of coarse particles (expressed by 150 μm residual quantity on the ordinate).

Figure 10:
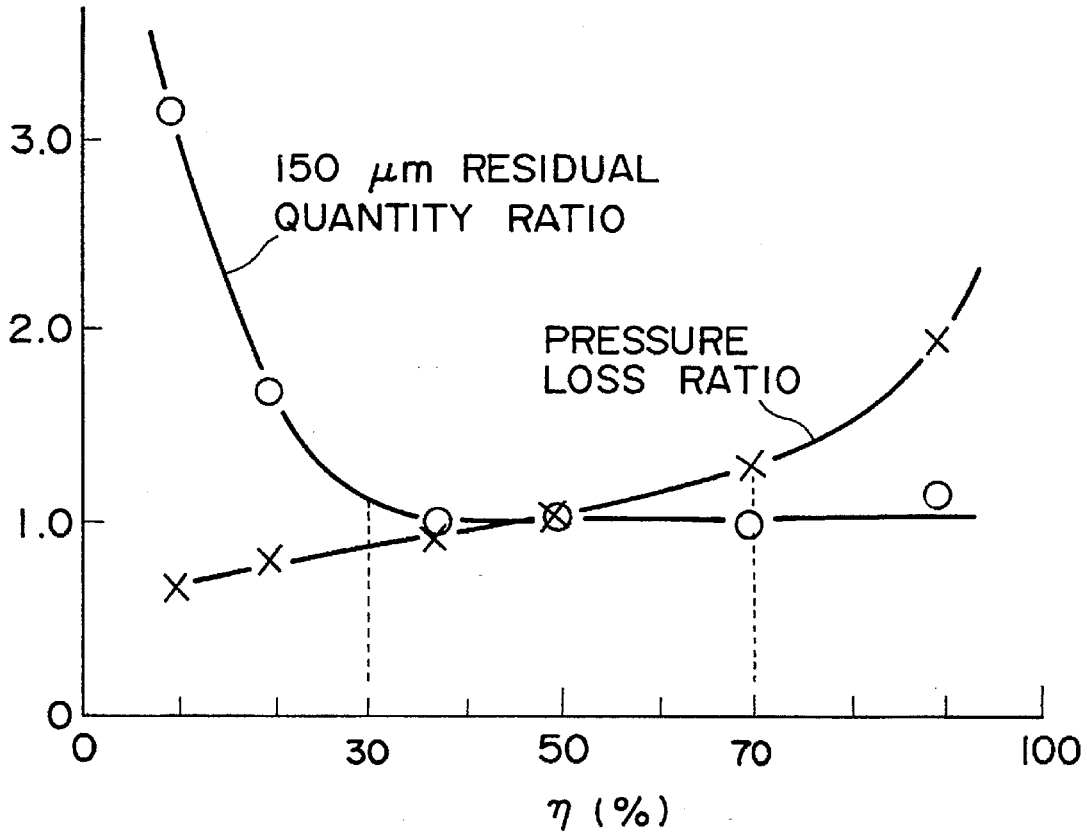
FIG. 10 is a view showing the optimum range of the present invention.

FIG. 10 shows a result of a test in which the level of the collision probability η was changed on a wide rotating vane. From this figure, it is found that a collision probability η not more than 30% remarkedly increases the amount of coarse particles and a collision probability η not less than 70% causes the pressure loss to increase. Therefore, the optimum range of collision probability η is 30 to 70%.

We claim:

1. A rotary classifier for separating coarse and fine particles entrained in a gas current, the rotary classifier comprising:

a first end to be disposed in the upstream direction of the gas current for receiving the particles and a second end to be disposed in the downstream direction of the gas current for discharging classified particles, the first end being of a reduced area relative to the area of the second end;

a plurality of vanes operatively disposed within the rotary classifier for orbital movement, each vane including an upstream end of a reduced width, a downstream end of an enlarged width relative to the upstream end, radially inner and outer edges, and first and second opposed flat surfaces bounded by the upstream and downstream ends and the radially inner and outer edges; and wherein the plurality of vanes are arranged relative to each other with the first flat surface of each vane facing the second flat surface of an adjacent vane, the vane upstream ends of reduced width are disposed adjacent to the first end of the rotary classifier, the vane downstream ends of enlarged width are disposed adjacent to the second end of the rotary classifier, and the radially inner edges of the plurality vanes diverge radially from the axis of orbital movement along the direction from the first end to the second end of the rotary classifier for improving coarse material separation efficiency.

2. The rotary classifier as recited in claim 1, wherein the width of each vane at its downstream end is 1.5 to 3 times the width of the vane at its upstream end.

3. The rotary classifier as recited in claim 1, wherein each vane exhibits a tapered width between its upstream and downstream ends.

4. The rotary classifier as recited in claim 1, wherein each vane includes a section of uniform width and another section of tapering width.

5. A rotary classifier for separating coarse and fine particles entrained in an upwardly moving gas current in a roller mill, the rotary classifier comprising:

a lower end to be disposed in the upstream direction of the gas current for receiving the particles and an upper end to be disposed in the downstream direction of the gas current for discharging classified particles, the lower end being of a reduced area relative to the area of the upper end;

a plurality of vanes operatively disposed within the rotary classifier for orbital movement, each vane including an upstream base end of a reduced width, a downstream top end of an enlarged width relative to the base end, radially inner and outer edges, and first and second opposed flat surfaces bounded by the base and top ends and the radially inner and outer edges; and wherein the plurality of vanes are arranged relative to each other with the first flat surface of each vane facing the second flat surface of an adjacent vane, the vane base ends of reduced width are disposed adjacent to the lower end of the rotary classifier, the vane top ends of enlarged width are disposed adjacent to the upper end of the rotary classifier, and the radially inner edges of the plurality vanes diverge radially from the axis of orbital movement along the direction from the first end to the second end of the rotary classifier for improving coarse material separation efficiency.

6. The rotary classifier as recited in claim 5, wherein the width of each vane at its top end is 1.5 to 3 times the width of the vane at its base end.

7. The rotary classifier as recited in claim 5, wherein each vane exhibits a tapered width between its base and top ends.

8. The rotary classifier as recited in claim 5, wherein each vane includes a section of uniform width and another section of tapering width.

9. A rotary classifier for separating coarse and fine particles entrained in a gas current, the rotary classifier comprising:

a first end to be disposed in the upstream direction of the gas current and a second end to be disposed in the downstream direction of the gas current;

a plurality of vanes operatively disposed within the rotary classifier for orbital movement, each vane including an upstream end mounted for orbital movement along a first circular path and a downstream end mounted for movement along a second circular path of larger diameter relative to the first circular path; and wherein the vanes are of greater width than thickness, and the width of each vane at its downstream end is greater than the width of the vane at its upstream end.

10. The rotary classifier as recited in claim 9, wherein the width of each vane at its downstream end is 1.5 to 3 times the width of the vane at its upstream end.

11. The rotary classifier as recited in claim 9, wherein each vane exhibits a tapered width between its upstream and downstream ends.

12. The rotary classifier as recited in claim 9, wherein each vane includes a section of uniform width and another section of tapering width.

* * * * *